United States Patent [19]

Kanoh et al.

[11] Patent Number: 4,607,604

[45] Date of Patent: Aug. 26, 1986

[54] OIL SEPARATOR FOR INTERNAL COMBUSTION ENGINE

[75] Inventors: Junichi Kanoh, Nagoya; Kongoh Aoki, Kariya, both of Japan

[73] Assignee: Aisin Seiki Kabushiki Kaisha, Kiraya, Japan

[21] Appl. No.: 706,446

[22] Filed: Feb. 27, 1985

[30] Foreign Application Priority Data

Mar. 5, 1984 [JP] Japan ..... 59-031908[U]

[51] Int. Cl.[4] ..... F02M 25/06

[52] U.S. Cl. ..... 123/572; 123/574

[58] Field of Search ..... 123/572, 573, 574, 41.86

[56] References Cited

U.S. PATENT DOCUMENTS

| | | | |
|---|---|---|---|
| 3,166,062 | 1/1965 | Yerman | 123/572 |
| 3,946,719 | 4/1976 | Bellanca | 123/572 |
| 4,064,853 | 12/1977 | Hatz | 123/574 |
| 4,370,971 | 2/1983 | Bush | 123/572 |

FOREIGN PATENT DOCUMENTS

| | | | |
|---|---|---|---|
| 3152747 | 6/1983 | Fed. Rep. of Germany | 123/573 |
| 2118861 | 11/1983 | United Kingdom | 123/573 |

*Primary Examiner*—Ronald H. Lazarus

*Attorney, Agent, or Firm*—Oblon, Fisher, Spivak, McClelland & Maier

[57] ABSTRACT

An oil separator for separating and collecting lubrication oil contained in blow-by gas of an internal combustion engine. The separtor is formed in the cylinderhead cover of the engine and incorporates a porous filter, which is made of foam metal for absorbing oil constituents in the blow-by gas, and a relief valve which is arranged between a chamber of the downstream-side of the porous filter and the crank case in order to pass the blow-by gas therethrough into downstream-side from the crank case when the internal pressure of the crank case increases.

3 Claims, 1 Drawing Figure

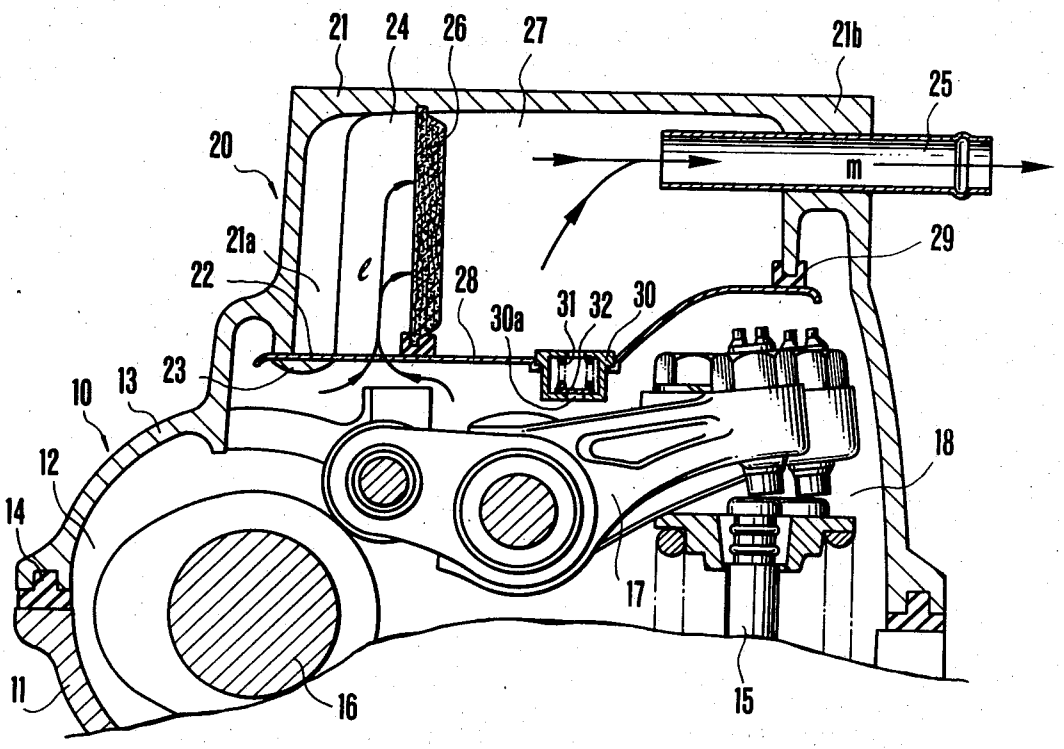
25
21b
m
29
18
15
17
30
32
31
30a
28
27
26
24
21
20
21a
22
23
13
10
12
14
11
16

OIL SEPARATOR FOR INTERNAL COMBUSTION ENGINE

BACKGROUND OF THE INVENTION

1. Field of the Invention

This invention relates to an oil separator for separating lubrication oil from blow-by gas which comes to be produced in an internal combustion engine.

2. Description of the Background

In operation of an internal combustion engine, some parts of gas in the combustion chamber leak into the crank case through a gap between the piston and the cylinder during compression and explosion strokes. This "blow-by" gas contains some volume of lublication oil constituents.

There have been proposed many devices for separating these lubrication oil constituents from the blow-by gas. For instance, in the device disclosed in the Bulletin of the Japanese Utility Model Laid-open No. 149013/1981 (No. Jitsu-kai-sho 56-149013), an oil separation case is arranged in a cylinder-head cover; a zig-zag path for the blow-by gas is formed in the case by means of arranging baffle plates therein; and the oil constituents contained in the gas are separated by the function of the zig-zag path which makes the flow direction of gas change abruptly. That is to say, while the gas itself can change its flow direction smoothly, oil particles heavier than a certain degree cannot make a sudden change of its flow direction, and consequently, such oil constituents collide against the wall of the zig-zag path and adhere thereto. When the number of adhered oil constituents increase, they come to form drops and fall along the wall by their own weight. The blow-by gas from which the oil constituents are excluded is sent to an intake manifold.

However, in the above way for separation, the fog-like fine oil particles tend to pass through the zig-zag path with the gas. This makes it difficult to separate and collect oil constituents completly from the blow-by gas, and consequently, the lublication oil comes to flow into the intake manifold without being separated completely. It will be apparent that these tendencies cause a drawback in that the comsumption volume of lubrication oil becomes large and various sensors installed to the manifold are contaminated with oil.

One effective way to avoid the above inconvenience is to use a porous filter for absorbing the oil constituents. In accordance with such device, a porous filter made of foam metal is arranged vertically in the chamber for separation of oil. When the blow-by gas flows into the separation chamber and passes through the porous filter, the oil constituents in the blow-by gas are absorbed by the porous filter. The absorbed oil falls along the surface of the filter and is reserved for recycling it to the cylinder. The upper portion of the porous filter is maintained as a path for gas, as the oil adhered to this portion is excluded therefrom according to the fall of oil. This would be a very efficient way for separating oil from the blow-by gas.

However, in using the porous filter as a means for separating oil, there are still a possibility of inconvenience. For instance, the blow-by gas sometimes contains the constituents of some foreign materials. Such foreign constituents are also absorbed by the porous filter and might clog pores of the filter. If the path for the gas in the filter comes to be closed by such foreign constituents, the inner pressure of the crank case will increase extraordinarily and the blow-by gas will leak outside of the engine through sealed portions such as the gasket portion between the cylinder and the cylinder-head cover.

SUMMARY OF THE INVENTION

The object of the present invention is to provide an improved oil separator for an internal combustion engine, which can perform efficiently the separation of lubrication oil from blow-by gas by the function of a porous filter, and at the same time, can avoid possible inconveniences accompanying the use of such filter.

In accordance with the present invention, there is arranged a relief valve between the crank case and the downstream-side chamber of the porous filter. When the internal pressure of the crank case increases and reaches to a predetermined degree, the relief valve opens and the blow-by gas runs into the downstream-side chamber of the filter from the inside of the crank case through the relief valve. Consequently, an extraordinary increase of the internal pressure of the crank case is avoided and leakage of blow-by gas from the sealed portion is prevented.

The foregoing and other objects, features and advantages of the present invention will be understood more clearly and fully from the following detailed description of preferred embodiments with reference to the attached drawing.

BRIEF DESCRIPTION OF THE DRAWINGS

The single FIGURE shows a vertical sectional view of one embodiment of the separator according to the present invention.

DESCRIPTION OF PREFERRED EMBODIMENTS

Refering to the drawing, a cylinder head 11 of an internal combustion engine 10 is covered by a cylinder-head cover 13, thereby forming an upper chamber 12. The cylinder-head cover 13 is fixed to the cylinder head 11, interposing a seal packing 14 between them. In the upper chamber 12, there is arranged a valve-actuating mechanism 18 comprising a cam shaft 16 and a rocker arm 17 for an intake or exhaust valve 15.

An oil separator 20 according to the present invention is constituted with a casing 21 being formed integrally with the cylinder-head cover 13 and having an open lower end 21*a*. At the open lower end 21*a* of the casing 21, there is fixed a baffle member 22 by such means as caulking to define a gas-liquid separation chamber 24. When the blow-by gas flows into the gas-liquid separation chamber 24 along the arrow mark " " from inside of the upper chamber 12 of the cylinder head 11, oil drops floating in the blow-by gas are intercepted by the baffle member 22 primary. The outlet port 25 for the blow-by gas is formed at the side wall 21*b* of the right side (in the drawing) of the casing 21 and communicates with an intake manifold (not shown) through a communicating means such as a rubber pipe.

In the gas-liquid separation chamber 24, a porous filter 26 made of foam metal having a three dimensional network structure and a porosity generally within the range from 94 1 to 96% is arranged vertically.

The filter 26 has a high efficiency to collect oil particles. The blow-by gas flowing into the gas-liquid separation chamber 24 decreases its flow-speed by colliding with the filter 26, and oil constituents contained in the blow-by gas adhere to the filter in the form of oil drops. The blow-by gas from which the oil constituents are excluded flows to the outlet port as shown by the arrow mark "m".

The downstream-side chamber 27 of the filter is separated from the upper chamber 12 of the cylinder head 11 by a partition member 28, which is formed as an extending part of the baffle member 22, and is sealed from the upper chamber 12 by a rubber seal member 29. In a housing 30 fixed to the partition member 28, there is arranged a relief valve 32, which is ordinarily biased to the closed position by a spring 31. When the internal pressure of the upper chamber 12 of the cylinder head 11 increases and reaches to a predetermined degree, the relief valve is opened and maintains the open position against the force of spring 31. Consequently, the downstream-side chamber 27 of the filter communicates with the upper chamber 12 through a path 30*a* of the housing 30 the porous filter 26.

As stated above, even if the ordinary path for the blow-by gas in the casing 21 comes to be closed and the internal pressure of the crank case increases extraordinarily owing to clogging of the filter, the blow-by gas can flow directly into the downstream-side chamber 27 of the filter through the opened relief valve 32. Therefore, by the function of the relief valve, an extraordirinary increase of the internal pressure of the crank case is prevented and the leak of blow-by gas through the sealed portion by such means as packing member 14 can be avoided.

It should be understood that the preferred embodiment of the present invention has been described herein in considerable detail and that certain modifications, changes, and adaptations may be made therein by those skilled in the art and that it is hereby intended to cover all modification, changes and adaptations thereof falling within the scope of the appended claims.

What is claimed is:

1. In an internal combustion engine including a crankcase ventilation system, an oil separator casing formed integrally with the cylinder-head over, a partition defining the lower end of the oil separator, a baffle member for intercepting oil drops contained in blow-by gas flowing into the oil separator from the upper chamber of the cylinder, and an outlet port formed in the wall of said oil separator casing to exhaust gas from the oil separator, wherein the improvement comprises:

said baffle member being arranged at the open lower end of the oil separator, a filter member made of foam metal and arranged so as to divide the inside of the oil separator into a gas-liquid separating chamber in the upperstream side where said baffle member is arranged and a downstream side chamber where said partition is arranged, said filter member functioning so as to absorb oil constituents contained in blow-by gas passing through said baffle member, a relief valve being arranged in said partition so as to be opened when the internal pressure of said upper chamber of the cylinder increases to a predetermined degree, to introduce the blow-by gas into said downstream-side chamber directly from said upper chamber of the cylinder.

2. An oil separator for an internal combustion engine of claim 1, further comprising caulking means for fixing said baffle member to said casing and a rubber seal member interposed between said partition and said casing.

3. An oil separator for an internal combustion engine of claim 2, wherein said partition further comprises an extended part of said baffle member.

* * * * *